United States Patent [19]

Kurama et al.

[11] Patent Number: 4,682,780

[45] Date of Patent: Jul. 28, 1987

[54] ROD CHUCKING DEVICE FOR A PERFORATOR FOR PERFORATING A PIG IRON DISCHARGE OPENING IN A BLAST FURNACE

[75] Inventors: Kenichiro Kurama, Hiroshima; Michiyasu Shibata, Yokohama, both of Japan

[73] Assignees: Mazda Motor Corporation, Hiroshima; Nippon Kokan Kabushiki Kaisha, Tokyo, both of Japan

[21] Appl. No.: 824,706

[22] PCT Filed: Apr. 16, 1985

[86] PCT No.: PCT/JP85/00205

§ 371 Date: Feb. 10, 1986

§ 102(e) Date: Feb. 10, 1986

[87] PCT Pub. No.: WO85/04904

PCT Pub. Date: Nov. 7, 1985

[30] Foreign Application Priority Data

Apr. 16, 1984 [JP] Japan ..... 59-56327

[51] Int. Cl.[4] ..... B23B 31/06; C21C 3/48

[52] U.S. Cl. ..... 279/79; 279/1 SG; 279/20; 266/271; 266/45

[58] Field of Search ..... 279/76, 79, 86, 4 R, 279/1 F, 1 TE, 97, 1 SG, 20, 1 SG; 72/453.02; 408/226, 56, 58, 59, 60, 61; 83/16, 171, 665, 666, 698; 409/135, 136; 266/45, 236, 269, 271

[56] References Cited

U.S. PATENT DOCUMENTS

| | | | |
|---|---|---|---|
| 2,448,278 | 8/1948 | Ronning | 279/97 |
| 3,762,264 | 10/1973 | Scott | 279/4 |
| 4,402,519 | 9/1983 | Meaden et al. | 279/76 |

FOREIGN PATENT DOCUMENTS

| | | | |
|---|---|---|---|
| 210214 | 2/1906 | Fed. Rep. of Germany | 279/86 |
| 8002717 | 12/1981 | Netherlands | 266/271 |
| 410093 | 5/1974 | U.S.S.R. | 266/271 |

*Primary Examiner*—Z. R. Bilinsky
*Assistant Examiner*—A. Dougas
*Attorney, Agent, or Firm*—Fleit, Jacobson, Cohn & Price

[57] ABSTRACT

A rod chucking device for a perforator for perforating a pig iron discharge opening being adapted to mount exchangeably perforating rods for perforation work, such as drill rods, blanking rods and the like to the tip end of an impact rod. The chucking device has a cotter movable between an engage position and disengage position in order to fix the perforating rod inserted into a rod insert hole of a socket. A spring is engaged with the cotter for urging the cotter toward the engage position. In order to prevent deterioration of the spring through vibration and heat during the operation, chilling air passage from the impact rod to the perforating rod is separated to form an air passage to chill the spring.

7 Claims, 4 Drawing Figures

ROD CHUCKING DEVICE FOR A PERFORATOR FOR PERFORATING A PIG IRON DISCHARGE OPENING IN A BLAST FURNACE

TECHNICAL FIELD

This invention relates to a perforator for perforating a pig iron discharge opening in a blast furnance. Specifically, this invention pertains to a rod chucking device for holding a perforating rod of the perforator, such as drill rod, blanking rod and the like.

BACKGROUND ART

Conventionally, an opening for discharging pig iron is formed by perforating wall of the blast furnance by means of a perforator. In this case, the perforator comprises a perforating rod, such as drill rod and blanking rod to thereby perform the perforating work. Since the perforating rod wears down remarkably through the perforating work, the perforating rod is necessary to be exchanged frequently and the exchanging work should be done under high temperature of the rod. A chucking device is provided in order to engage the perforating rod with an actuator or impact rod. In conventional chucking devices, the chucking device normally has a structure in which a socket is connected to the impact rod of the perforator, a perforating rod is inserted into a rod hole of the socket to be fixed thereto and the perforating rod is locked through a cotter. In this case, the exchange work of the perforating rod are usually carried out by hand.

It is preferred that the exchange work of the perforating rod is automated because of a hard work under bad conditions, such as high temperature, high dust. For the purpose, it is necessary that the cotter is movable between an engage position and disengage position and the cotter is urged against the engage position by a spring. In the conventional rod chucking device, however, vigorous vibrations are transmitted to the socket through the impact rod to vibrate the spring violently during operation As the result the spring is heated to the temperature of 300° C.-400° C. within a short time to produce a deterioration of material, spring constant and tensile strength resulting in losing spring function, fracture in only 20–30 minute use, and increase of wear.

Under these circumstances, it is suggested that materials having a high strength properties at high temperature, such as Inconel, are employed for the spring. However, since the spring of Inconel is very expensive and the spring is necessary to be exchanged frequently because of its short life, it will not be allowable in the cost.

DISCLOSURE OF THE INVENTION

An object of the invention is to provide a rod chucking device for a perforator for forming pig iron discharge openings of a blast furnance which can solve the above problem.

A further object of the invention is to provide a rod chucking device of which perforating rod can be exchanged automatically and is inexpensive and durable.

In order to accomplish the above objects, the rod chucking device in accordance with the present invention characterized by a socket being connected with a tip end portion of a impact rod of a perforator at the rear end portion, a rod insert hole being formed at the front portion of the socket to mount the perforating rod thereto, a cotter for securing the perforating rod to a cotter hole formed in the socket perpendicular to the rod insert hole being disposed movably between an engage position and a disengage position, a spring being provided for urging the cotter to the engage position, a rod connecting hole for connecting the impact rod to the socket being communicated with a spring mount hole through an air passage, air from the impact rod being injected to the spring mount hole through the air passage to thereby chill the spring.

According to the present invention, a part of the air supplied to the perforating rod through the impact rod is always supplied for chilling the spring to thereby restrain undesirable heating of the spring to improve the duration thereof. Further, the cotter is adapted to move between the engage position and the disengage position, and be urged against the engage position so that automating of exchange of the perforating rods can be readily accomplished.

BEST MODE FOR CARRYING OUT THE INVENTION

Figure 1:
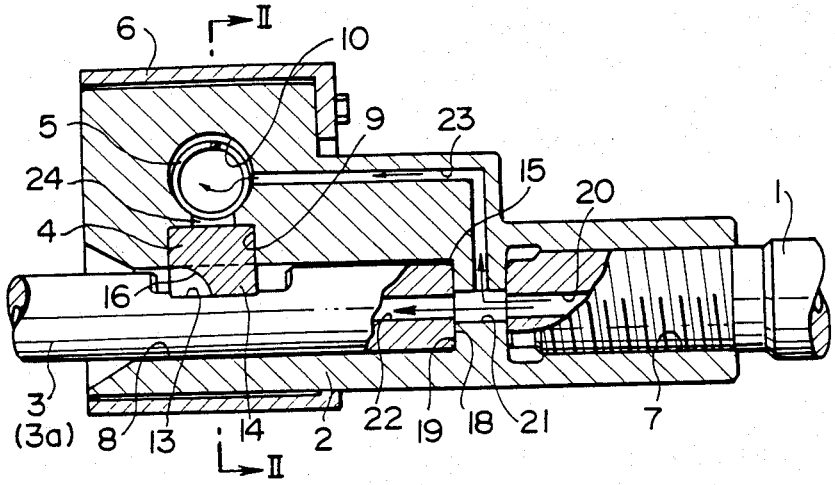
FIG. 1 is longitudinal sectional view of a rod chucking device for perforating according to the embodiment of the present invention.

A rod chucking device for perforating pig iron discharge openings of a blast furnace is shown in drawings. The rod chucking device comprises a socket connected to a tip end portion of an impact rod 1 of a perforator (not shown), a cotter 4 for securing a perforating rod 3 to the socket 2 with the perforating rod 3 mounted to the socket 2 at the base portion, a coil spring for urging the cotter, and a cotter guide.

A rod connecting hole 7 is formed in the rear portion of the socket 2 for connecting to the impact rod 1. The tip end portion of the impact rod 1 is screwed into the rod connecting hole 7 to connect to the socket 2. A rod insert hole 8 is formed in the front portion of the socket 2. The rod insert hole 8 is concentric to the rod connecting hole 7. In the socket 2, there is formed a cotter hole 9 perpendicular to the rod insert hole 8 and connected to the hole 8. A spring mount hole 10 is disposed parallel to the cotter 4 at the upper portion of the cotter hole 9.

The cotter hole 9 has the substantially square configuration in section in the area above the rod insert hole 8 at one side of the hole 9 and extends upward to be communicated with the spring mount hole 10 at the other side.

There is disposed the cotter 4 movably in the cotter hole 9. A coil spring 5 is mounted between a spring seat portion 4*a* of the cotter 4 projecting into the spring mount hole 10 and an end wall 10*a* of the hole 10 through end plates 11 so that the cotter is urged in the outerward direction (in the left direction in FIG. 2).

The base portion of the perforating rod 3 is adapted to be inserted into the rod insert hole 8 of the socket 2 to be engaged with the cotter 4. When necessary, the perforating rod 3 can be removed as described below. An arched recess 12 is formed at the lower side of the cotter 4 for allowing the perforating rod 3 to pass through when the cotter 4 is located at a disengage position where the cotter 4 moves rightmost (see FIG. 3). On the other hand, an engaging portion 14 is formed on the cotter 4 for engaging with an engaging recess 13 of the perforating rod 3 when the cotter 4 is located in an engage position where the cotter 4 moves leftmost (see FIG. 2). There is, further formed an arched slant guide surface 16 at the lower side of the cotter for abutting to the base end portion 15 of the perforating rod 3 when the rod is inserted into the rod insert hole 8 so that the cotter can move to the disengage position. The upper end 16*a* of the guide surface 16 is smoothly continued on the upper surface of the rod insert recess 12. The cotter 4 is further provided with a slant surface 17 inclined in the right direction in FIG. 2 from the upper portion of the recess 12. The slant surface 17 is inclined at 20–30 deg to the bottom surface 13*a* of the engaging recess 13 formed on the perforating 3 when the cotter 4 is located in the engage position.

According to the above structure, when the perforating rod 3 is inserted into the socket 2 to mount thereto, the guide surface 16 is pushed by the base end portion 15 of the perforating rod so that the cotter is forced to move to the disengage portion against the spring 5. Then, the rod insert recess 12 is overlapped with the rod insert hole 8 so that the perforating rod 3 can be inserted to be mounted on the socket 2.

When the base end surface 18 of the rod 3 is abutted on the end surface 19 of the rod insert hole 8 and the engaging recess 13 of the rod 3 is aligned with the cotter hole 9, the cotter 4 is pressed by the spring 5 to move to the engage position to thereby engage the engaging portion 14 with the engaging recess 13 so that the perforating rod 3 is secured to the socket 2 by means of the cotter 4.

Figure 2:
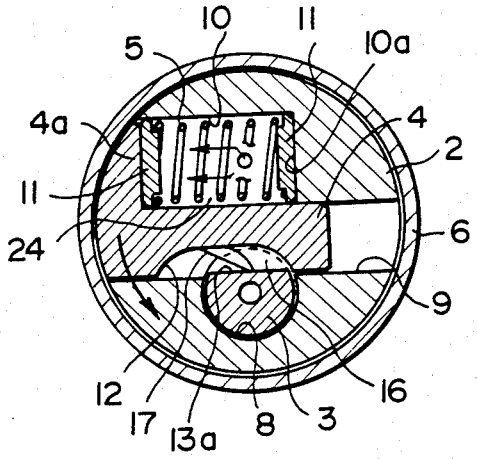
FIG. 2 is a sectional view taken by line II—II.
Figure 3:
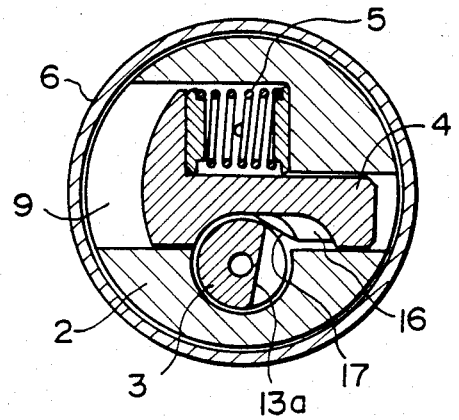
FIG. 3 is a similar view as FIG. 2 showing a disengage position of the cotter.
Figure 4:
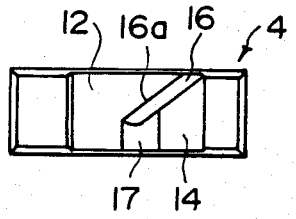
FIG. 4 is a bottom view of the cotter.

When the perforating rod is removed from the socket 2, the socket 2 is rotated in the direction of arrow in FIG. 2 by the rotation force of the impact rod 1 with the perforating rod 3 being fixed by a clamp or the like (not shown). Consequently, the slant surface 17 of the cotter 4 is abutted on the bottom surface 13*a* of the engaging recess 13 to be pressed by the bottom surface 13*a* so that the cotter moves to the disengage position (see FIG. 3). In turn, the socket 2 moves backward with the impact rod 1, or the perforating rod 3 moves forward so that the perforating rod 3 can be removed from the socket 2.

A cotter guide 6 is provided around the socket 2 at the front portion thereof and abutted on the outer surface of the cotter to hold the cotter 4. The cotter guide 6 is fixed to the socket 2 by means of bolts or the like. When the cotter guide 6 moves backward, the cotter 4 and spring 5 are adapted to be removed from the socket 2.

Viewing that the spring 5 is fairly heated because of a violent vibration of the socket 2 from the impact rod 1, a chill means for chilling the spring 5 is provided as described below.

When pig iron discharge openings are formed in a wall of a blast furnace by means of a perforator, in the first stage, a drill rod 3*a* is employed for perforating the wall as a perforating rod 3. In the last stage, a blanking rod is employed to open the openings as the perforating rod 3. In this case, in order to chill the drill rod 3*a* and remove dust resulting from the perforation, air is introduced from the perforator to the drill rod 3*a*.

The air from the perforator is supplied from an air passage 20 formed in the impact rod 1, passes through a communicating passage 21 for communicating the rod connecting hole 7 and the rod insert hole 8, and is introduced to an air passage 22 in the drill rod 3a.

An air passage 23 is formed in the socket 2 for conducting a part of the air to the spring mount hole 10 wherein the starting portion of the air passage 23 is opened to the communicating passage 21 and the end portion of the air passage 23 is opened to the spring hole.

The air passage 23 can be constituted by pipings.

In the above constitution, the air is supplied by way of the air passage in the impact rod 20, the communicating passage 21 and the air passage 23 to be impacted into the spring mount hole 10 to thereby chill the whole of the spring 5 effectively. Then, the air is conducted from opening 24 under the spring mount hole 10 to the cotter hole 9, and from the spring mount hole 10 to gaps around the spring seat 4a and discharged from gaps between the socket 2 and the cotter guide 6.

When the blanking rod (not shown) is employed for the perforating rod 3, it is not necessary to supply the chilling air to the blanking rod. However, the air is supplied to the spring mount hole 10 in the manner as mentioned above.

Thus, the spring 5 is always chilled by the air. Therefore undesirable heating of the spring 5 be avoided so that the spring 5 can give full play to the performance and improve the durability.

We claim:

1. A rod chucking device for a perforator for perforating a pig iron discharge in a blast furnace, said rod chucking device comprising a rod insert hole formed in a front portion of said socket for mounting a perforating rod, said perforating rod being inserted into said rod insert hole, a cotter for securing said perforating rod, said cotter being slidably mounted in a cotter hole formed in said socket perpendicularly to said rod insert hole so that said perforating rod is adapted to be locked in said socket, said cotter being disposed movably between an engage position and a disengage position, a spring for urging said cotter towards said engage position, a rod connecting hole for connecting said impact rod with said socket, said rod connecting hole being in communication with a spring mount hole through an air passage so that air supplied from said impact rod is injected into said spring mount hole through said air passage to chill said spring.

2. The rod chucking device in accordance with claim 1 wherein said air passage is separate from other air passages communicating between said impact rod and said perforating rod.

3. The rod chucking device in accordance with claim 1 wherein said air passage is formed in said socket.

4. The rod chucking device in accordance with claim 1 wherein a cam-shaped guide surface is formed on said cotter for engaging a tip end portion of said perforating rod when said perforating rod is inserted into said rod insert hole of said socket, said cam-shaped guide surface being adapted to produce a driving force for moving said cotter to said disengage position.

5. The rod chucking device in accordance with claim 4 wherein a rod insert recess is formed in said cotter with said recess being overlapped with said rod insert hole.

6. The rod chucking device in accordance with claim 5 wherein an engaging recess is formed in the perforating rod, said engaging recess being aligned with said cotter at a position where said perforating rod is inserted into said rod insert hole.

7. The rod chucking device in accordance with claim 4 wherein means for pressing said cotter opposite to said disengage position is provided when said perforating rod rotates relative to said socket.

* * * * *